US006251033B1

(12) United States Patent
Davidson

(10) Patent No.: US 6,251,033 B1
(45) Date of Patent: Jun. 26, 2001

(54) PAINTBALL GAME FIELD AND METHOD OF PLAY

(76) Inventor: Steven J. Davidson, 204 S. 4th St., Flagler Beach, FL (US) 32136

( * ) Notice: Subject to any disclaimer, the term of this patent is extended or adjusted under 35 U.S.C. 154(b) by 0 days.

(21) Appl. No.: 09/388,776

(22) Filed: Sep. 2, 1999

Related U.S. Application Data

(60) Provisional application No. 60/136,986, filed on Jun. 1, 1999.

(51) Int. Cl.[7] ..... A63B 71/02
(52) U.S. Cl. ..... 473/415; 473/469; 473/490
(58) Field of Search ..... 473/415, 465, 473/469, 471, 474, 490; 472/92

(56) References Cited

U.S. PATENT DOCUMENTS 5,219,316 * 6/1993 Huffman .
5,868,637 * 2/1999 Poxon .

OTHER PUBLICATIONS

Special Paintball Leisure Activity Time, SPLAT, by Durty Dan, wysiwyg://33/http://www.geocities.com/TimesSquare/2827/splat.html. Nov. 1993.*
1999 NPPL Rules, wysig://51/http://paintball.about.com/ . . . htm?iam=dpile$terms=painball+flag+rules, Jan. 1999.*
Austrailasian Paintball Players League Rules, http://www.lisp.com.au?~cwp/paintball/pbapplrules.htm, Jan. 1999.*

* cited by examiner

*Primary Examiner*—William M. Pierce
(74) *Attorney, Agent, or Firm*—Andrus, Sceales, Starke & Sawall, LLP

(57) ABSTRACT

A method and playing field for a competitive paintball game that increases the amount of action occurring during the game period. The playing surface for the paintball competition includes a pair of goals located near opposite end lines of the playing surface, each of which is defended by an opposing team. The playing surface is divided into a plurality of individual zones and includes a series of field bunkers positioned along the playing surface. The paintball competition is played for a predetermined game time divided into separate periods. During each period, each of the opposing teams attempts to carry their flag through the opposing team's goal before being shot by a paintball from the opposing team. When one of the paintball teams scores, points are awarded to the scoring team based upon the position of the opposing team's flag at the time the goal was scored by the scoring team. The flag may be passed between members of each team during the game play. A series of different penalties are assessed to each of the teams during game play based upon violations of the rules under which the paintball competition is run. Upon receiving a penalty, the penalized player must leave the playing surface and remain within a penalty box for the penalty period.

18 Claims, 2 Drawing Sheets

PAINTBALL GAME FIELD AND METHOD OF PLAY

CROSS-REFERENCE TO RELATED APPLICATION

This application is based on and claims priority from Provisional Application Ser. No. 60/136,986, filed on Jun. 1, 1999.

BACKGROUND OF THE INVENTION

The present invention generally relates to a game field and method for playing competitive paintball. More specifically, the present invention relates to a method and set of rules for playing competitive paintball that increases the amount of game action and scoring to create a game that appeals to spectators.

The game of paintball generally includes two separate teams of players that each have paintball guns. The paintball guns use compressed gas to propel paint-filled gelatin or plastic shells at players from the opposing team. When a paintball strikes an opposing player, the shell breaks and leaves a splatter mark of paint on the player, indicating that the player has been eliminated.

Currently, paintball competitions are played using one of two basic formats —"center flag" or "dual flag". In a center flag competition, a single flag is hung at the middle of the playing field. Two competing teams start from different ends of the playing field and attempt to capture the flag and carry it to their opponent's flag station on the opposite end of the field. In the dual flag system, each of the opposing teams begins the game at opposite ends of the field with their team's flag hanging at their own flag station. The object of the game for each team is to capture the opposing team's flag and return it to their team's station while at the same time protecting their team's flag from capture from the opposing team. In each of these games, a team player is eliminated by being shot by a paintball fired from a member of the opposing team.

In the conventional paintball games described above, points are typically awarded for the number of opponents eliminated during the game and for the first team to grab the opponent's flag, with additional points being given to the first team to hang their opponent's flag in the proper station. Each paintball match is played until one of the teams captures their opponent's flag and returns it to the proper flag station, or until the game time expires. Since points are awarded to both teams based on the number of opponents eliminated, a premium is placed on avoiding elimination. As an illustrative example, if a player gets eliminated, the player is giving points to the opposing team, regardless of which team is successful in capturing the flag. This type of scoring places a burden on the individual players to avoid being eliminated by making risky moves or engaging in risky strategies of play. Therefore, paintball games typically evolve into a series of long-range shooting duels, frequently with little or no action for long periods of time.

Because players on each of the opposing teams in a conventional paintball competition tend to remain behind stationary bunkers or obstacles and engage in long-range shoot-outs, paintball competitions have not been able to attract a large number of spectators, either for live action events or televised broadcasts of competitive tournaments. Therefore, a need exists for a paintball game including a set of rules that encourages a fast-paced, high-scoring competition that allows viewers to follow the action and be entertained by risky and daring playing strategies.

It is an object of the present invention to provide a method of playing a paintball competition that rewards players for aggressive and risky movements between bunkers organized on a playing surface. It is an additional object of the invention to provide a scoring system that rewards the scoring team for scoring a goal, while determining the number of points awarded based upon the position of the opponent's flag when the scoring team scores. It is an additional object of the present invention to provide a paintball game that includes various penalties for improper game play and removes a player from the game for committing one of specified penalties. It is an additional object of the present invention to place a time limit on the paintball game that is divided into several individual timed periods. Further, it is an object of the invention to provide a paintball game that returns each team to full strength after each score and upon completion of each period, thereby encouraging the players from each team to make daring moves and score as many points as possible during each period. Finally, it is an object of the present invention to provide a paintball game having a set time limit as opposed to prior games having a varying time limit.

SUMMARY OF THE INVENTION

The present invention is a new method, set of rules and playing surface for a paintball competition that increases the amount of action occurring during the competition and increases the desirability of the paintball game for spectators.

The competitive paintball game of the present invention includes a playing surface extending between two end lines and defined by a pair of spaced, parallel side lines. Each end of the playing surface includes a start zone in which opposing teams stand prior to the beginning of game play. The playing surface is divided into a plurality of zones and includes a series of field bunkers positioned on the playing surface and spread between the individual zones. The playing surface also includes a pair of goals, each being positioned in close proximity to one of the end lines of the playing surface. Each goal includes a pair of spaced vertical uprights.

During game play, each of the opposing teams attempts to carry their flag in opposite directions across the playing surface while attempting to shoot opposing players and avoid being struck by a paintball fired by the opposing team. If a player from either one of the two teams is struck from a paintball fired by the opposing team, the player is eliminated and must leave the playing surface.

The game play continues until each player from one of the two teams is eliminated or until a player from either team, scores by carrying the team's flag through the opposing team's goal. When the player carrying his team's flag passes through the opposing team's goal, points are awarded to the scoring team based on the position of the opposing team's flag at the time the goal is scored. Specifically, an increasing number of points are given to the scoring team the further the opposing team's flag is from the scoring team's goal. Thus, both teams are encouraged to advance their own flag as far down the playing surface as possible as quickly as possible to either score points by passing through the opposing team's goal or to reduce the number of points scored by the opposing team.

After either of the teams score, each of the teams return to their start zone and the eliminated players re-enter the game. Thus, each time a goal is scored, both teams return to full strength before the game resumes.

The paintball competition has a specified game time limit, which is divided into a plurality of time periods. In the embodiment of the invention disclosed, the game time is divided into three separate periods. At the termination of each period, both teams switch sides and are returned to full strength by lining the players up again in the start zone.

During the game play, penalties are assessed to players from each team if the players violate the rules set out for running the paintball game. Upon incurring a penalty, the penalized player must leave the playing surface and remain within a penalty box until the penalty period has expired. Additionally, penalties may be incurred that require the entire penalized team to move back or to return their team's flag to the penalized team's goal. The imposed penalties not only regulate the game play but also cause the play to be stopped upon the incurrence of a penalty, thereby allowing the game officials to control the action.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
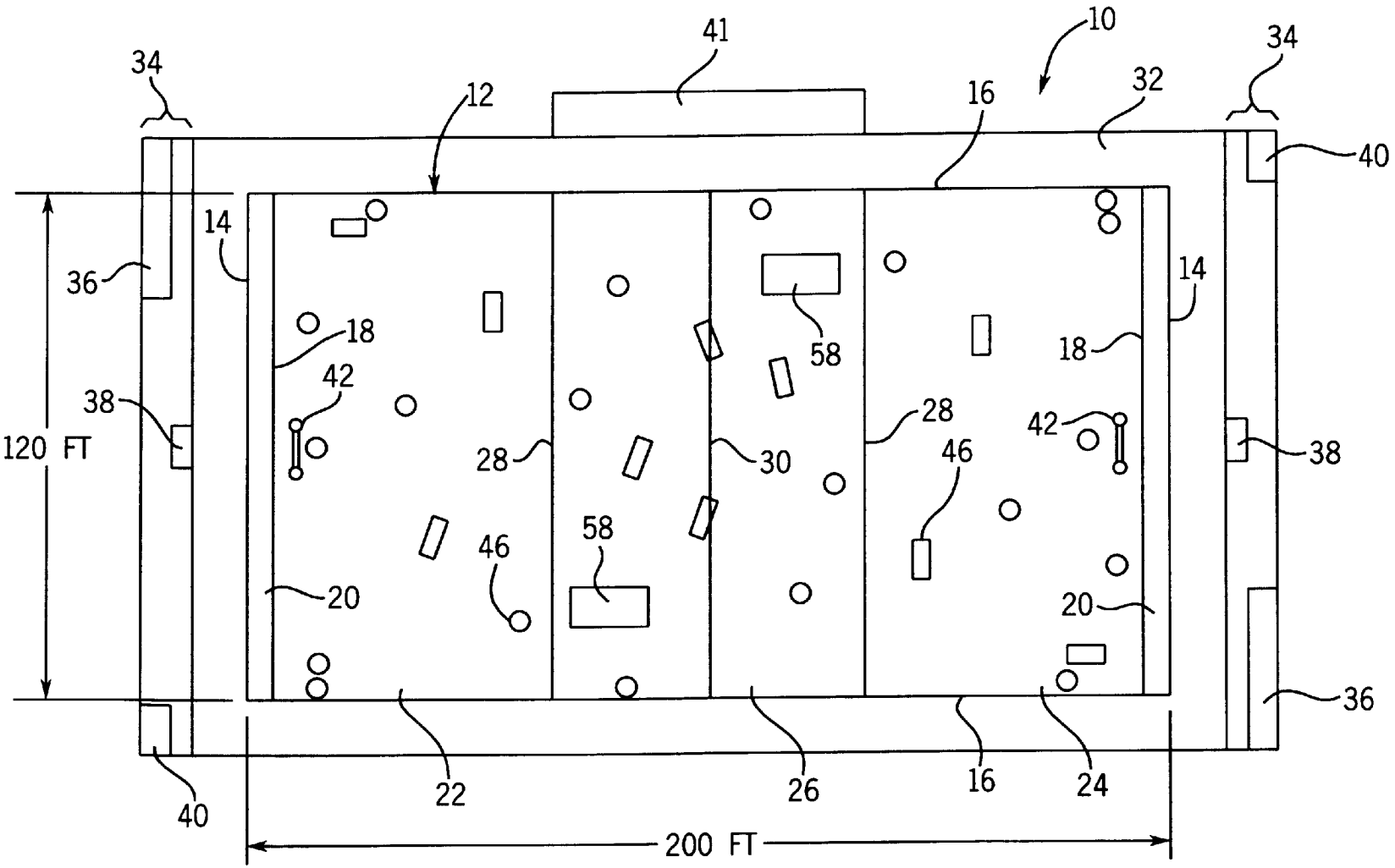
FIG. 1 is a top plan view of the playing field constructed in accordance with the present invention.

Referring now to the drawings, FIG. 1 illustrates a paintball game field 10 for playing a competitive paintball game in accordance with the rules and method of the present invention. In the preferred embodiment of the invention shown in FIG. 1, the paintball game field 10 includes a playing surface 12 having a length of approximately 200 feet and a width of approximately 120 feet. It is contemplated that the paintball game field 10 can be located either indoors or outdoors and the size of the playing field 12 is selected such that the game may be played in an indoor facility such as those in which hockey and Arena football are currently played. The playing surface 12 is generally flat and may be constructed from numerous types of materials, such as natural or artificial turf, clay, sod, dirt or any other suitable, non-skid, no dust surface.

The playing surface 12 is generally defined by a pair of spaced, parallel end lines 14 and a pair of spaced, parallel side lines 16 that connect the two end lines 14 and form a right angle at each junction. In the preferred embodiment of the invention, each of the end lines 14 and side lines 16 are six inch wide white chalk or paint lines that define the playing surface 12. The playing surface 12, as can be seen in FIG. 1, is rectangular having the desired dimensions as defined by the pair of end lines 14 and side lines 16.

A start line 18 is spaced from each of the end lines 14 to define a start zone 20 contained on each end of the playing surface 12. Preferably, each start line 18 is spaced five feet from the nearest end line 14, such that the start zone 20 has a width of five feet and extends the entire width of the playing surface 12 between the spaced side lines 16.

The playing surface 12 is divided into a first team zone 22, a second team zone 24 and a neutral zone 26 by a pair of zone lines 28. Each of the zone lines 28 is parallel to the end lines 14 and extend across the entire width of the playing surface 12 between the side lines 16. The first team zone 22, second team zone 24 and neutral zone 26 are used to determine the scoring during a paintball competition played on the playing surface 12, as will be discussed in greater detail below. In the preferred embodiment of the invention, both the first team zone 22 and the second team zone 24 have a length of 60 feet, as measured from the end line 14 to the nearest zone line 28. The neutral zone 26 has a length of 80 feet extending between the pair of zone lines 28. The neutral zone 26, in turn, is divided in half by a centerline 30. Preferably, each of the zone lines 28 and the centerline 30 is a six inch wide white paint or chalk line extending between the parallel side lines 16. The centerline 30 also includes a red and a blue line positioned on opposite sides of the centerline 30 to differentiate the centerline 30 from the zone lines 28.

The entire playing surface 12 is surrounded by a walkway 32 that allows players and officials to walk along the playing surface 12 without interfering with the game occurring on the playing surface 12. In the preferred embodiment of the invention, the walkway 32 extends along both of the side lines 16 and both of the end lines 14 and has a width of approximately ten feet. Alternatively, it is contemplated that the walkway 32 could be eliminated or formed along only one of the side lines 16 or only one of the end lines 14, depending upon the amount of room available for the paintball game field 10.

In addition to the walkway 32, a back field 34 is positioned along each end of the playing surface 12. Each back field 34 includes a team bench area 36, a goal judge box 38 and a penalty box 40. The team benches 36 are contained on each end of the game field 10 to provide a location for game players to store equipment and rest when they have been eliminated from the game action or between breaks in play. Alternatively, the team benches 36 could be positioned on the same side of the game field 10. The goal judge boxes 38 provide a location for a goal judge to sit and monitor scoring taking place on the playing surface 12. The penalty box 40 provides a location for players to sit when they have been removed from a game for committing a penalty.

An official's box 41 is positioned along one of the side lines 16 and includes the game clock and scoring equipment for the paintball competition. In addition, the official's box 41 provides a place for the game officials to sit and monitor the game action.

Figure 2:
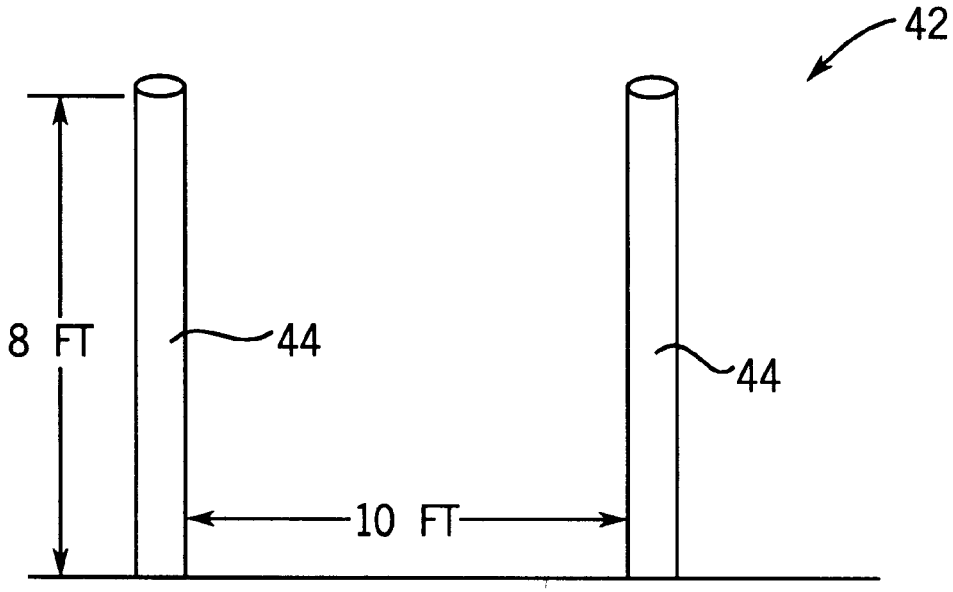
FIG. 2 is a front view of a bunker utilized on the playing field of FIG. 1.

The playing surface 12 includes a pair of goals 42 placed in close proximity to each of the end lines 14. In the preferred embodiment of the invention, each goal 42 is located ten feet from the nearest start line 18. Referring now to FIG. 2, in the preferred embodiment of the invention, each goal 42 includes a pair of spaced uprights 44 that define a goal area contained therebetween. In the preferred embodiment of the invention, the uprights are spaced approximately ten feet apart and extend eight feet above the playing surface 12. Referring back to FIG. 1, each of the individual uprights 44 is spaced approximately 55 feet from the nearest side lines 16.

The playing surface 12 includes a plurality of field bunkers 46 spaced along the entire area of the playing surface 12. The field bunkers 46 shield the players from being shot by paintballs fired by the opposing team as they move between the different zones defined on the playing surface 12. In the preferred embodiment of the invention, each field bunker 46 is generally cylindrical, having a length of approximately six feet and a height of four feet. The size and shape of each field bunker 46 provides adequate cover for the players while not blocking the action for spectators of the paintball game.

In accordance with the preferred embodiment of the invention, between 30 and 40 individual field bunkers 46 are placed upon the playing surface 12. The field bunkers 46 are distributed evenly among the first team zone 22, the second team zone 24 and the neutral zone 26. Preferably, the field bunkers 46 are placed in a specific pattern such that the pattern forms a mirror image when a diagonal line is run from one corner of the playing surface to the diagonally opposite corner. Typically, the field bunkers 46 will be set on the playing surface 12 based upon a pre-approved pattern for the current season of competition in a league operating under the scope of the present invention.

Figure 3:
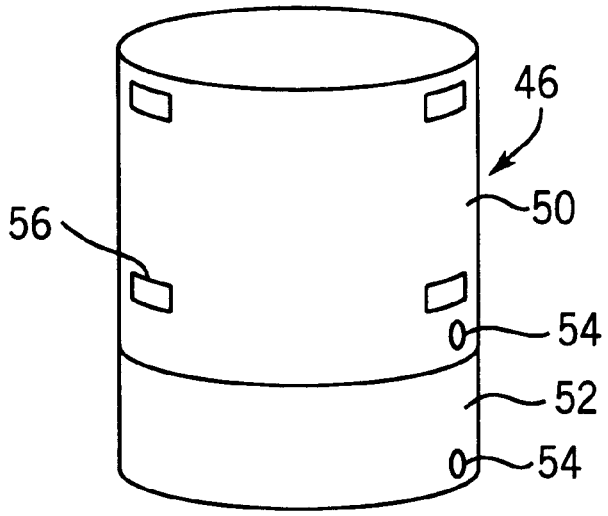
FIG. 3 is a front view of a goal positioned on the playing field of the present invention.

Referring now to FIG. 3, a typical field bunker 46 is shown. The field bunker 46 includes an upper portion 50 and a lower portion 52, each of which can be inflated by a valve 54. In the preferred embodiment of the invention, the upper portion 50 includes attachment means 56 that allows advertisements to be displayed on each of the field bunkers 46. Although the field bunker 46 is shown as being inflatable and having a generally cylindrical shape, it is contemplated that the field bunkers 46 could be of any desired configuration large enough to provide cover for the players while operating within the scope of the present invention.

Game Objectives

The paintball game field 10 shown in FIG. 1 is configured for use by a pair of opposing teams. Each team consists of a plurality of individual players, of which only a predetermined number may be on the playing surface 12 at any one time. In the preferred embodiment of the invention, only seven players from each team may be on the playing surface 12 at any given time. Although the invention contemplates each team consisting of seven "active" players, a different number of players could be used while still operating within the scope of the invention.

Each player on both of the opposing teams carries a single 0.68 caliber paintball gun, which is either semi-automatic or pump action. Preferably, each of the paintball guns is powered by high-pressure air, nitrogen or $CO_2$ bottles that propel paintballs at a speed not greater than 300 feet per second. Each of the players is required to wear appropriate protection, including eye protection.

The general object of the game is for the two teams to simultaneously advance their team's flag in opposite directions along the playing surface 12 until a player from one of the teams carries his team's flag through the opposing team's goal before being shot. Once one of the flags has been carried through the opposing team's goal, points are awarded to the scoring team based on the position of the opponent's flag when the goal was scored, as will be discussed in greater detail below. The paintball competition is continued for a preselected game time and the team having accumulated the most points at the expiration of the game time is declared the winner.

Starting the Game

Before the game begins, seven "active" players from each of the opposing teams position themselves anywhere within their team's start zone 20 contained on opposing ends of the playing surface 12. For example, the players from the first team position themselves in the start zone 20 adjacent to the first team zone 22, while the players from the second team position themselves in the start zone 20 adjacent to the second team zone 24. Preferably, the opposing teams are differentiated by colored arm bands placed on the arms of each player. Before the game begins, one player from each team is holding his team's flag.

Once all the players from each team are positioned in their respective start zones 20, a horn or whistle is blown to indicate the beginning of play. After the start whistle has been blown, the players from each team begin to advance along the length of the playing surface 12 while hiding behind the field bunkers 46 to avoid being shot by a paintball from the opposing team. At the same time, each player is also attempting to eliminate players from the opposing team by shooting the opposing players with paintballs from their paintball guns.

Elimination

As previously discussed, a player is eliminated immediately upon a paintball breaking anywhere on the player's body or equipment and leaving a splatter mark on the hit player. If a player is hit by a paintball shot by the opposing team, the player must leave the playing surface 12 and return to the team bench area 36 for his team. Once eliminated, the player cannot return to the playing surface 12 until the time remaining in the current period expires, or upon a score from either of the two opposing teams.

If a player is hit by a paintball from the opposing team which leaves a mark and the player continues to play, the player incurs a penalty based upon the location of the hit. For example, if the player is hit and the paintball breaks on either the front of the player's body, all of the player's arms and hands, the forward half of all of a player's legs, all of a player's feet, all of a player's gun and loader, all of a player's air tank if mounted on the gun, and all of the equipment carried on the front half of the player's body, the player incurs the most severe penalty. If a player continues to play after incurring such an obvious/easy to detect hit, the player himself is eliminated and two players from his team are placed in the penalty box 40 for a penalty period of three minutes. Additionally, the player's entire team is moved back to their team zone 22 or 24 or their start zone 20 depending upon each player's location at the time of the penalty.

The second type of hit is an obvious/hard to detect hit that is defined as any hit that occurs on the top or back of a player's head and any area of the rear half of the player's body which is not covered by equipment. If a player continues to play after receiving an obvious/hard to detect hit, the player is removed from the playing surface 12 and another player from the hit player's team is placed in the penalty box or a penalty period of three minutes.

The last type of hit is a non-obvious hit that occurs against equipment on he rear half of the player's body. If the player continues to play after receiving a non-obvious hit, the player is removed from the playing surface by one of the officials without any additional penalties being incurred by the player's team.

Flag Movement

Once the game has begun, each team moves their flag along the length of the playing surface toward the opposing team's goal in an attempt to have a player from the team pass through the opposing team's goal with the flag in hand. As the game is being played, the players on each team may carry or throw the flag to any other player on the same team. In this manner, each team can quickly move the flag around the field and deceive the opposing team as to where the flag is currently located on the playing surface 12.

Each team may throw their flag any number of times between players within the boundaries of one of the three zones defined on the playing surface 12. Additionally, flags may be thrown backwards (towards a team's own goal) any number of times during the course of play. However, limitations exist as to how the flag may be thrown forward during the course of play.

For the purposes of the present paintball game, a forward pass is defined as a thrown flag which moves over a zone line 28 in the direction of the opposing team's goal. According to the rules of the current paintball game, flags may be thrown only over one zone line 28 at a time. For a single zone pass to be legal, a player from the passing team must be currently in the zone into which the flag is being passed. Or, a player from the passing team must cross into the new zone prior to the passed flag crossing the zone line. If a flag passes into a new zone prior to a player from the passing team entering the new zone, the pass is considered to be "off-sides".

Any forward pass that crosses over two zone lines is illegal and considered to be an "two-line" pass regardless of where the players on the passing team are located. Any player who makes an off-sides pass or a two-line pass is immediately eliminated from the game and the flag is positioned on the ground in the penalized team's goal.

During a paintball competition, if the player on either team carrying his team's flag is eliminated by being shot by the opposing team, the player carrying the flag must drop the flag in the location where the player was shot. The team flag remains on the playing surface 12 until another player from the same team can retrieve the flag. When a flag is laying on the playing surface 12, only players from the dropped flag's team can touch the flag. Opposing players cannot pick up the flag from an opposing team or maneuver it in any way.

Time of Play

Currently, it is contemplated by the inventor that a complete paintball game played in accordance with the invention will be broken into three individual periods, each of which will have a seven minute time limit. The three individual periods will each be separated by a rest time, typically around three minutes. The rest time between periods not only allows the players to rest and recover, but also provides adequate commercial breaks if the paintball game is televised. The game clock, which is used to determine the official time of the game, starts upon the beginning of play and continues to run until a penalty is called or until a team scores by having one of their players pass through the opposing team's goal 42 carrying the team's flag. After one of the teams scores, both of the teams return to the start zone in which they began the current period. At this time, all of the players that were eliminated before the goal was scored can return to action. Once the players from each team are set, a whistle is blown to resume play and the game clock resumes running.

Upon the completion of each period, a horn sounds and the players from each team switch sides so that they will be moving across the playing surface 12 in an opposite direction as compared to the previous period. Thus, the opposing teams switch sides twice a game to ensure that neither team gains any advantage based on the field layout.

In addition to the game clock, a penalty clock is utilized to determine the amount of time a penalized player must remain within the penalty box 40 upon incurring a penalty. Typically, a penalty keeper keeps track of the penalty time, which runs concurrently with the game clock.

Finally, a score clock is also utilized in playing the paintball game of the present invention. The score clock is set such that upon the elimination of the last player on one of the teams, the separate countdown "score" clock is started by the time keeper. Preferably, the score clock will be set so that it begins at thirty seconds and counts down to zero. If the players on the team not eliminated do not score within this thirty second time period, the game clock is stopped and the players returned to their respective start zones without any points being scored by either team. The score clock thus places a time limit for a team to run their flag through the opposing team's goal after the entire opposing team has been eliminated. This feature of the paintball game of the present invention forces each team to keep track of the number of players on the opposing team that are still alive such that when the last opposing team player has been eliminated, the players on the opposite team must quickly react to score an unopposed goal.

Scoring

An unique feature of the paintball game of the present invention is the manner in which points are awarded to the scoring team. As previously discussed, a team scores a goal when a player from the scoring team passes through the opposing team's goal carrying the scoring team's flag. The player passing through the opposing team's goal carrying the flag must pass completely between the pair of goal posts 44 prior to being struck by a paintball from the opposing team. The number of points awarded to the scoring team is determined by the position of the opponent's flag at the time the player from the scoring team passes through the goal. Specifically, the number of points awarded to the scoring team is greater the further the opposing team's flag is from the scoring team's goal. The scoring team is awarded the lowest number of points if the opponent's flag has been moved a long distance along the playing surface and is relatively close to the scoring team's goal. In the preferred embodiment of the invention shown in the drawings, three point values are assigned for a score:

1) Max—seven points. Awarded when the scoring team's flag is carried through the opponent's goal when the opponent's flag is located in the opponent's own team zone;
2) Hang—three points. Defined as carrying the flag through the opponent's goal when the opponent's flag is in the neutral zone; and
3) Goal—one point. Defined as carrying the flag through the opponent's goal when the opponent's flag is in the scoring team's own team zone.

As an illustrative example, if Team 1 starts from the start zone 20 nearest the first team zone 22 and scores a goal through the goal 42 in the second team zone 24 while the Team 2's flag is still in the second team zone 24, Team 1 scores a "Max" and is awarded seven points. However, if Team 2's flag is in the neutral zone 26 when Team 1 scores, Team 1 scores a "Hang" and is awarded three points. Finally, if Team 2's flag is in the first team zone 22 when Team 1 scores, Team 1 is awarded a "Goal" and receives only a single point.

The scoring system of the present invention encourages each of the teams to advance their flag as quickly as possible as far down the playing surface 12 as possible, since the location of the non-scoring team's flag determines the number of points awarded to the scoring team. This method of scoring is vastly different from conventional paintball games which only awards the scoring team for moving a flag to a designated position, regardless of the opposing team's flag position. Additionally, the scoring system of the present invention does not award points based on the number of players eliminated from the opposing team or the number of players remaining on the scoring team. Therefore, the scoring system of the paintball game of the present invention encourages each of the teams to undertake risky strategies, since eliminations do not affect the scoring.

Although the preferred embodiment of the invention has been shown and discussed as being played upon a playing surface 12 divided into three separate zones and awarding points based on the three zones, it is contemplated by the inventors that the playing surface could be divided into any number of zones. Regardless of the number of zones, the scoring system of the present invention is set up to award points to the scoring team based on the position of the opponent's flag when the goal is scored. In any case, the number of points awarded to the scoring team will be greater the further the opponent's flag is from the scoring team's goal when the goal is scored.

In a contemplated alternate embodiment of the invention, the playing surface 12 can include a pair of shot zones 58, as shown in FIG. 1. The shot zones 58 are marked on the playing surface 12 and are located away from any of the field bunkers 46. The shot zones 58 provide a location for a player from each team to stand and throw the flag in an attempt to make the flag pass through a basket (not shown) mounted to one of the goal posts 44 of the goal 42. If the flag passes through the basket, the scoring team is awarded fifteen points. However, if the flag fails to pass through the basket, the flag remains upon the playing surface 12 and can be picked up by either team. The only time a team can pick up the opposing team's flag is when the opposing team has missed scoring by taking a shot from the shot zone 58. The shot zone 58 is meant to provide each team with a "Hail Mary" option to score points when passing through the goal 42 would be extremely difficult or when the opposing team is about to score.

Penalties

During a paintball competition organized and run in accordance with the rules of the present invention, penalties are assessed to players from each team for violating the rules of the game. When a penalty has been incurred, the player committing the infraction is either penalized by being placed in his team's the penalty box 40 or the entire team is penalized by either having to move back to their start zone 20 or team zone 22 or 24, depending on the position of the team when the penalty is incurred. For example, if a player on Team 1, which started the period in the start zone 20 near the first team zone 22, is penalized and some players on the penalized team are in the first team zone 22 and other players are in other zones, the players in the first team zone 22 will be moved to their start zone 20 and the remaining players will be moved back into the first team zone 22. Alternatively, some penalties may result in the penalized team's flag to be placed on the ground within the penalized team's goal.

In the preferred embodiment of the invention, a plurality of referees are positioned around the playing surface 12 to monitor the game action and call penalties when a rule is violated. The referees are allowed to move around the playing surface 12 to monitor for penalties and help determine when a player has been eliminated by being struck by a paintball.

Listed below is a description of the type of penalties that can be incurred during a paintball competition organized within the scope of the present invention:

RUSHING: Continuing to play with a hit in the obvious/easy to detect area.

CONTINUING TO PLAY MAJOR: Continuing to play with a hit in the obvious/hard to detect area.

CONTINUING TO PLAY MINOR: Continuing to play with a hit in the not obvious area.

HOT GUN: Leaving the field with a gun shooting over the speed limit of 300 feet per second.

MOVING OUT OF BOUNDS: Stepping over the playing boundary with at least one foot; placing a hand past the field boundary line; crossing the field boundary line with the flag; shooting with a gun which is over the boundary line.

OFF-SIDES: Throwing a flag forward across a zone line when no player from the passing team has passed across the zone line or remains live in one of the zone forward of the line to be passed over.

TWO-LINE PASS: A flag is thrown forward across two zone lines in a single throw.

FLAG OUT OF BOUNDS: A flag is thrown, kicked or moved in some manner across the field boundary line.

BAITING: A player moves from his set position prior to the start of play.

ILLEGAL SCORE: A player who has been hit passes through the goal with the flag in possession.

ILLEGAL FLAG MOVE: A player who has been hit attempts to move (carry, pass, kick) a flag across a zone line.

DELAY OF GAME: A player hinders the progress of the game by leaving the field of play slowly, moving to a bunker slowly, delaying a restart of the game.

TOO MANY PLAYERS ON THE FIELD: During a re-start a team has 8 or more players on the playing surface.

ILLEGAL TEAM MEMBER ON THE FIELD: A coach, assistant coach or non-playing member of a team enters the playing field.

COACH IN AN ILLEGAL AREA: The designated team coach leaves the area for coaching during play.

DISTRACTING GAME OFFICIALS: A player or non-playing member of a team attempts to talk to or otherwise distract a game official.

ARGUING WITH OFFICIALS: A player on the field or a member of the coaching staff off the field argues with a call, threatens—physically or verbally—or engages in behavior which is intended to demonstrate disagreement or dissatisfaction with a referee's call.

INAPPROPRIATE LANGUAGE: A player uses offensive language.

PHYSICAL CONTACT: A player touches, either with a part of his body or carried equipment, another player on the opposing team.

FIGHTING: Pushing, shoving, kicking, punching, pulling or any other physically abusive actions taken by a player against a member of the other team.

CONTRIBUTING TO A FIGHT: Additional players or coaching staff entering into a physical conflict.

ALTERING TERRAIN: Moving or attempting to move an on-field barrier.

USE OF TOOLS OR ALTERING VELOCITY ON FIELD: The player is found to be in possession of tools or implements which can be used to alter a gun's velocity (they do not have to be capable of altering the velocity of the owning player's gun) or the player is found to be altering the gun in a manner which could raise the gun's velocity.

EXCESSIVE INFRACTIONS: The team has accumulated 3 or more penalties which resulted in the removal of an additional player.

FAILURE TO OBEY SAFETY REGULATIONS: A player fails to use barrel plug, discharges their gun inappropriately or fails to wear their goggles in areas where they are required.

FAILURE TO MAINTAIN PROFESSIONAL CONDUCT: A team or players on a team engage in activity outside of the event which is deemed to be detrimental to the event, the league or sponsors.

MOVING, SHOOTING OR COMMUNICATING DURING A PENALTY STOP: A player or players moves more than three steps after the whistle, shoots after the whistle or communicates after the whistle.

EARLY START: A player or players steps over the start line prior to the official start of the game.

When a player from either of the teams commits one of the penalties described above, the player and possibly other members of his team incur the penalties as set forth in the following table:

INFRACTION AND PENALTY TABLE

| Infraction | Penalized Players Removed | Additional Players Removed From Play | Penalty Time Served | Team Moved Back | Flag Moved Back to Goal | Player Ejected | Player Suspended | Player Fined |
|---|---|---|---|---|---|---|---|---|
| Rushing | Y | Y-2 | 3 minutes | Y | Y | N | N | N |
| Continuing to Play - Major | Y | Y-1 | 3 minutes | N | N | N | N | N |
| Continuing to Play - Minor | Y | N | N | N | N | N | N | N |
| Hot Gun | N | N | 3 minutes | N | N | N | N | N |
| Moving Out of Bounds | Y | N | N | N | N | N | N | N |
| Off Sides | Y | N | N | N | Y | N | N | N |
| Two Line Pass | N | N | N | Y | Y | N | N | N |
| Flag Moved Out of Bounds | N | N | N | N | Y | N | N | N |
| Baiting | Y | N | N | N | N | N | N | N |
| Illegal Score | Y | Y-2 | 5 minutes | Y | Y | N | N | N |
| Illegal Flag Move | Y | Y-1 | 5 minutes | N | Y | N | N | N |
| Delay of Game | Y | N | N | N | N | N | N | N |
| Too Many Players | Y | Y-1 | 3 minutes | N | N | N | N | N |
| Illegal Player | N | Y-1 | N | N | N | Y | N | $50 |
| Coach/Staff in an Illegal Area | N | Y-1 | 3 minutes | N | N | Y | N | $50 |
| Distracting Officials | Y | N | 3 minutes | N | N | Maybe | N | $25 |
| Arguing | Y | N | 5 minutes | N | N | Maybe | Maybe | $50 |
| Use of Inappropriate Language | Y | N | N | N | N | Maybe | Maybe | $25 |
| Physical Contact | Y | N | 5 minutes | N | N | Maybe | N | $50 |
| Fighting | Y | Y-2 | 10 minutes | N | N | Yes | Maybe | $100 |
| Contributing to a Fight | Y | N | 5 minutes | N | N | Maybe | Maybe | $100 |
| Altering Terrain | Y | N | 3 minutes | N | N | N | N | N |
| Use of Velocity Altering Tools | Y | N | 5 minutes | N | N | Maybe | Maybe | $75 |
| Safety Violation | Y | N | 5 minutes | N | N | Maybe | Maybe | $25 |
| Unprofessional Conduct | N | N | N | N | N | Y | Maybe | $500 |
| Moving, Shooting or Communicating During a Penalty Stop | Y | N | 3 minutes | N | N | N | N | N |

When a player has been removed from the playing surface 22 due to a penalty, the penalty time does not begin until the penalized player has become seated in the penalty box 40. A penalized player must remain in the penalty box 40 until the penalty period has expired. Once the penalty period has expired, the player must return to the team bench and cannot re-enter the playing surface 12 until the next official start of play, such as following a score or at the beginning of a new period. If the penalty period has not expired when the play is stopped because of a score or the end of a period, the player must remain in the penalty box 40 until the penalty period ends.

Although the present invention has been discussed including numerous specific rules, field configurations and penalties, it is contemplated by the inventors that a paintball game played in accordance with the present invention may occur including all or some of the specific rules set forth, depending upon the skill level of the players and the particular competition being undertaken. However, it should be understood that a paintball game played in accordance with the present invention provides for action that is more enjoyable to spectators and easy to follow from locations near the game field 10.

Various alternatives and embodiments are contemplated as being within the scope of the following claims particularly pointing out and distinctly claiming the subject matter regarded as the invention.

I claim:

1. A method of playing a paintball game between a first team of players and a second team of players, wherein each player has a paintball gun for discharging paintballs, the method comprising the steps of:

providing a playing surface having a first end line and a second, opposing end line, the playing surface being divided into at least three zones;

positioning the first team of players near the first end line, the first team having the objective to score points by carrying a first team flag through a first goal positioned near the second end line before being shot by one of the second team players;

positioning the second team of players near the second end line, the second team of players having the objective to score points by carrying a second team flag through a second goal positioned near the first end line before being shot by one of the first team players;

awarding a point value to the first team each time a player from the first team crosses the first goal carrying the first team flag, the point value being based upon the zone in which the second team flag is located when the first team crosses the first goal, wherein the point value awarded to the first team increases the further the second team flag is from the second goal;

awarding a point value to the second team each time a player from the second team crosses the second goal carrying the second team flag, the point value being based upon the zone in which the first team flag is located when the second team crosses the second goal, wherein the point value awarded to the second team increases the further the first team flag is from the first goal; and determining a winning team based on which of the first team and the second team accumulates the largest point total over a predetermined game time.

2. The method of claim 1 further comprising the step of distributing a plurality of bunkers on the playing surface, the bunkers being placed in each of the zones on the playing surface.

3. The method of claim 2 wherein the bunkers are generally equally distributed throughout the plurality of zones.

4. The method of claim 1 further comprising the steps of:

dividing the game time into a plurality of individual periods, each period having a predetermined time limit; and repositioning each of the first and second teams near the end lines at the completion of each period.

5. The method of claim 1 further comprising the step of repositioning both the first team and the second team near the respective end lines each time a player from one of the teams scores by crossing the goal carrying the team flag.

6. The method of claim 1 further comprising the step of removing a player from the playing surface when the player is shot by a paintball.

7. The method of claim 6 further comprising the step of repositioning the players from the first team and the second team near the respective end lines after a player from one of the teams scores by crossing the goal carrying the team flag, including repositioning the players previously eliminated by being shot.

8. The method of claim 1 further comprising the steps of:

removing a player from the playing field for a penalty period when the player commits a penalty infraction, the penalty period being less than the game time; and returning the penalized player to the playing field only upon expiration of the penalty period.

9. The method of claim 1 wherein the playing field is divided into three individual zones, including a first team zone, a second team zone, and a neutral zone positioned between the first team zone and the second team zone.

10. The method of claim 9 wherein the step of determining the point value to be awarded to the first team includes awarding seven points to the first team if the second team's flag is in the second team zone, awarding three points if the second team's flag is in the neutral zone, and awarding one point if the second team's flag is in the first team zone; and wherein the step of determining the point value to be awarded to the second team includes awarding seven points to the second team if the first team's flag is in the first team's zone, awarding three points if the first team's flag is in the neutral zone, and awarding one point to the second team if the first team's flag is in the second team's zone.

11. The method of claim 1 wherein each goal includes a pair of spaced uprights.

12. A method of playing a paintball game between a first team of players and a second team of players, wherein each player has a paintball gun for discharging paintballs, the method comprising the steps of:

providing a playing surface having a first end line and an opposite second end line, the playing surface being divided into at least three zones;

positioning the first team of players near the first end line, the first team having the objective to score points by carrying a first team flag through a first goal positioned near the second end line;

positioning the second team of players near the second end line, the second team of players having the objective to score points by carrying a second team flag through a second goal positioned near the first end line;

removing the players from the playing surface when the player is hit by a paintball;

removing the players from the playing field for a penalty period when the player commits a penalty infraction;

determining a point value to be awarded to the first team each time a player from the first team crosses the first goal carrying the first team flag, the point value awarded to the first team being greater the further the second team flag is from the second goal;

determining a point value to be awarded to the second team each time a player from the second team crosses the second goal carrying the second team flag, the point value awarded to the second team being greater the further the first team flag is from the first goal;

repositioning the players from both the first team and the second team near the respective end lines after a player from either the first team or the second team scores by crossing the goal carrying the respective team flag;

resuming the paintball game after the players have been repositioned near the respective end lines; and determining a winning team based on which of the first team and the second team has accumulated the largest point total over a predetermined game time.

13. The method of claim 12 further comprising the step of distributing a plurality of bunkers on the playing surface, the bunkers being placed in each of the zones on the playing surface.

14. The method of claim 12 further comprising the steps of:

dividing the game time into a plurality of individual periods, each period having a predetermined time limit;

repositioning each of the first and second teams near their respective end lines at the completion of each period; and resuming the paintball game after the players have been repositioned near their respective end lines.

15. The method of claim 14 further comprising the step of returning the players hit by a paintball to the paintball game upon the resumption of the paintball game after a score and after the completion of each period.

16. The method of claim 12 wherein the playing field is divided into three individual zones, including a first team zone, a second team zone, and a neutral zone positioned between the first team zone and the second team zone.

17. The method of claim 16 wherein the step of determining the point value to be awarded to the first team includes awarding seven points to the first team if the second team's flag is in the second team zone, awarding three points if the second team's flag is in the neutral zone, and awarding one point if the second team's flag is in the first team zone; and wherein the step of determining the point value to be awarded to the second team includes awarding seven points to the second team if the first team's flag is in the first team's zone, awarding three points if the first team's flag is in the neutral zone, and awarding one point to the second team if the first team's flag is in the second team's zone.

18. A method of playing a paintball game between a first team of players and a second team of players, wherein each player has a paintball gun for discharging paintballs, the method comprising the steps of:

providing a playing surface having a first end line and an opposite second end line, the playing surface being divided into a plurality of zones;

positioning the first team of players near the first end line, the first team having the objective to score points by carrying a first team flag through a first goal positioned near the second end line;

positioning the second team of players near the second end line, the second team of players having the objective to score points by carrying a second team flag through a second goal positioned near the first end line;

determining a point value to be awarded to the first team each time a player from the first team crosses the first goal carrying the first team flag, the point value awarded to the first team being greater the further the second team flag is from the second goal;

determining a point value to be awarded to the second team each time a player from the second team crosses the second goal carrying the second team flag, the point value awarded to the second team being greater the further the first team flag is from the first goal; and determining a winning team based on which of the first team and the second team has accumulated the largest point total over a predetermined game time.

* * * * *